US005727830A

United States Patent [19]

Asher

[11] Patent Number: 5,727,830

[45] Date of Patent: Mar. 17, 1998

[54] SHOVEL FOR PACKED AND HEAVY SNOW

[76] Inventor: Randall S. Asher, 8756 S. Aberdeen Cir., Highlands Ranch, Colo. 80126

[21] Appl. No.: 803,810

[22] Filed: Feb. 24, 1997

[51] Int. Cl.[6] ..... E01H 5/02

[52] U.S. Cl. ..... 294/54.5; 294/56; 37/285

[58] Field of Search ..... 294/49, 54.5, 55, 294/56, 59; 37/265, 278, 285, 903; 172/381; 15/257.9

[56] References Cited

U.S. PATENT DOCUMENTS

| | | | |
|---|---|---|---|
| 249,665 | 11/1881 | Pettebone | 294/49 |
| 1,042,352 | 10/1912 | Kohler | 294/54.5 |
| 1,571,818 | 2/1926 | Ternan et al. | 294/49 |
| 4,149,744 | 4/1979 | Bonnes . | |
| 4,199,181 | 4/1980 | Mason . | |
| 4,264,095 | 4/1981 | Lemasters | 294/54.5 |
| 4,280,727 | 7/1981 | Germain | 294/54.5 |
| 4,531,713 | 7/1985 | Balboni | 294/54.5 |
| 4,804,219 | 2/1989 | Berg . | |
| 5,306,061 | 4/1994 | Ives | 294/49 |
| 5,419,600 | 5/1995 | Tisbo et al. . | |
| 5,533,768 | 7/1996 | Mitchell | 294/54.5 |

FOREIGN PATENT DOCUMENTS

| | | | |
|---|---|---|---|
| 3632-662 | 3/1988 | Germany | 294/49 |

*Primary Examiner*—Dean Kramer

[57] ABSTRACT

A snow shovel is presented capable of reducing the amount of work needed to clear heavy and packed snow. The shovel is composed of a handle, shaft and scoop each of molded plastic. The invention comprises a scoop with a front edge and two stainless steel leading edges-angled at approximately 160 degrees. This orientation results in a snow shearing force as the scoop is moved through heavy and packed snow reducing the amount of energy required for the removal of heavy and packed snow.

1 Claim, 2 Drawing Sheets

SHOVEL FOR PACKED AND HEAVY SNOW

FIELD OF INVENTION

This invention relates generally to hand tools and, more particularly to shovels used for removal of snow and specifically to a shovel for the removal of packed, heavy or icy snow.

BACKGROUND OF THE INVENTION

The shovel is a well-known hand tool used primarily for transfer of objects from one location to another. Conventional snow shovels have been used for ages in the removal of snow from driveways, sidewalks or other areas from which snow must be removed. The shovel is used in a pushing motion to drive the scoop though the snow. This snow is then lifted and deposited in an area away from the area being cleared. This process can work well in very light and undisturbed snow. However, if the snow is melting, or been compressed by the, passing of feet or automobiles, the process of pushing the scoop through the snow becomes exceedingly difficult, due to the increase in snow density. The result is over exertion and frustration in the shovel user. Often the user will remove only the soft snow and leave the compressed snow in place presenting a slippery hazard to those using the area which has been cleared.

The area of most resistance in the process of shovel use is the leading edge of the shovel scoop, which makes the initial contact with the snow and separates the snow so the scoop may follow. In conventional shovels the leading edge has almost always been a straight edge pushed by the user in an orientation perpendicular to the to forces applied to the handle. The process works well in very light and unpacked snow. However, in heavy or packed snow the wide edge of the snow shovel will stop due to the inability of the user to provide enough pressure to force the edge through the heavy or packed snow. The result is a tremendous increase in friction when the snow is heavy or packed. The snow shovel of this invention uses a leading edge of two sections, each section proceeding from the center of the front edge of the scoop to the lateral sides. These leading edge sections form an angle of approximately 160 degrees. Each section of leading edge forms an angle of approximately 80 degrees with respect to the center line of the scoop. Thus, the leading edge sections are at oblique angles to the movement of the shovel while in use, shearing through packed and heavy snow, dramatically reducing the amount of energy required to move the leading edge and scoop through the snow.

Most previous attempts have focused on attempts to make the snow shovel lighter, U.S. Pat. Nos. 4,149,744 and 5,419,600. Thus, in theory to decrease the amount of energy required to lift the snow. This does not address the friction from heavy and packed snow.

U.S. Pat. No. 4,199,181, shows a snow pusher with trapezoidal scoop, designed to push snow off to the side. The leading edge is set at an angle to the handle. However, this is only to aid in maintaining direction of movement, not to decrease friction, since the leading edge is "extending crosswise to with respect to the direction that the scoop is advanced over a surface to be cleared of snow" (Column 3, Lines 26–28).

As far as the applicant is aware of, none of the above-described patented snow shovels has addressed the problem of increased friction from heavy and packed snow.

BRIEF DESCRIPTION OF THE INVENTION

This invention provides a shovel for the removal of heavy and packed snow, wherein an angled leading edge, composed of two sections is attached to a conventional shovel scoop, shaft and handle, resulting in decreased friction and an ease of pushing the leading edge and scoop through heavy and packed snow.

In a preferred embodiment of the invention, a conventional handle, shaft and scoop, of this invention uses a leading edge composed of two sections, each section proceeding from the center line of the scoop to the intersection of the leading edge sections and lateral sides of the scoop, such that the two sections form an internal angle of approximately 160 degrees. Thus, leading edge sections are at a 10 degree angle to the path of movement when the scoop is passed through the snow. The leading edge is composed of a rigid material, such as stainless steel, aluminum or other materials having similar characteristics.

Details of the invention will be described or will become apparent during the course of the following description.

BRIEF DESCRIPTION OF THE DRAWINGS

Illustrative and presently preferred embodiments of the invention are illustrated in the accompanying drawing in which.

DETAILED DESCRIPTION OF THE INVENTION

Figure 1:
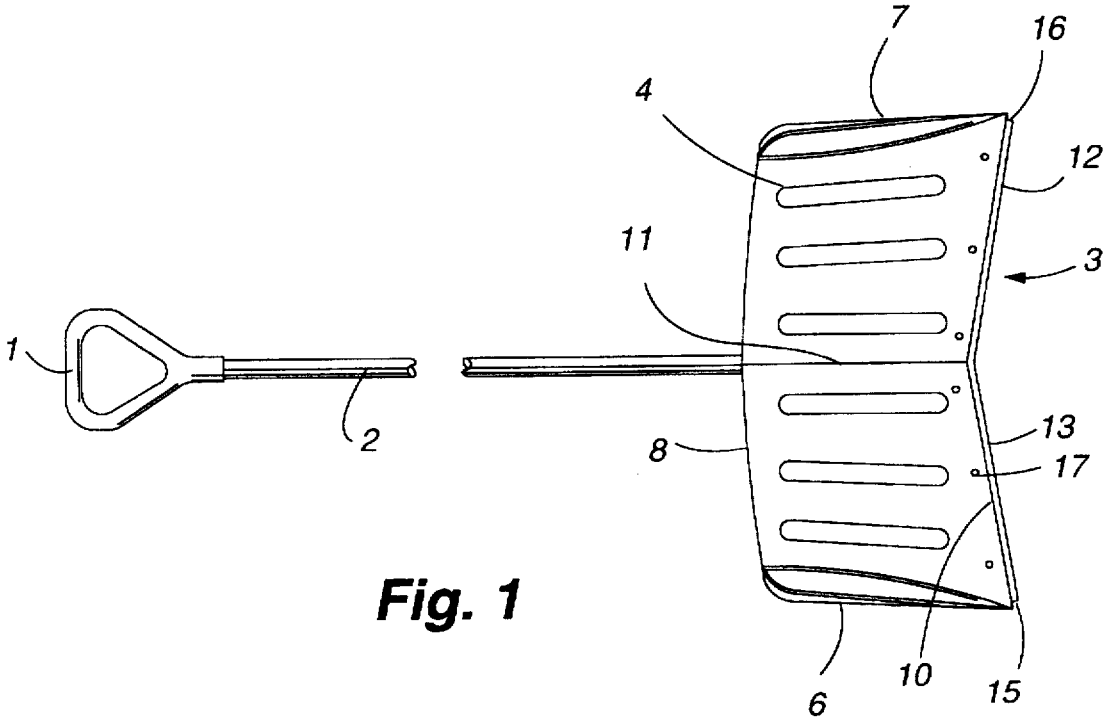
FIG. 1 is a top plane view of this invention illustrating a handle, shaft, scoop, and the leading edge.
Figure 2:
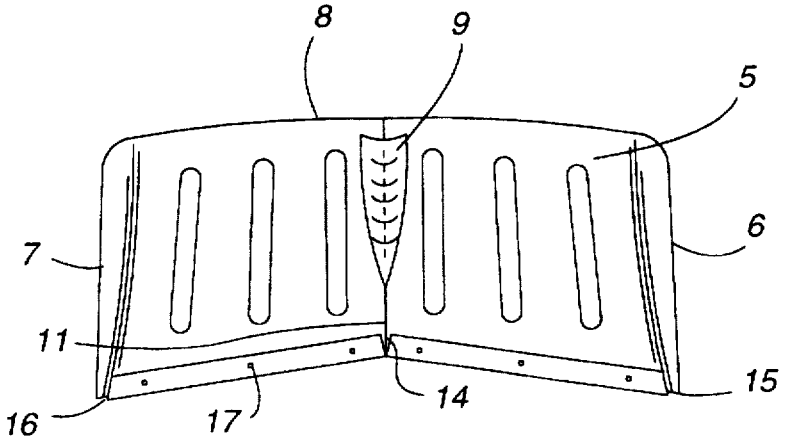
FIG. 2 is a bottom plane view of the scoop and leading edge.
Figure 3:
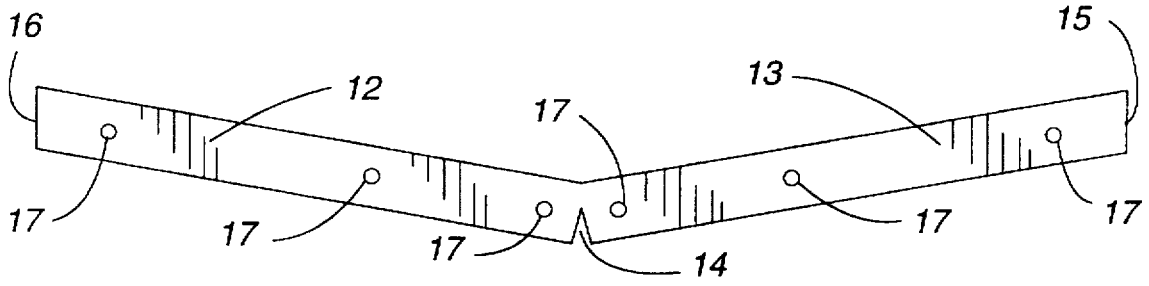
FIG. 3 top plane view of leading edge.
Figure 4:
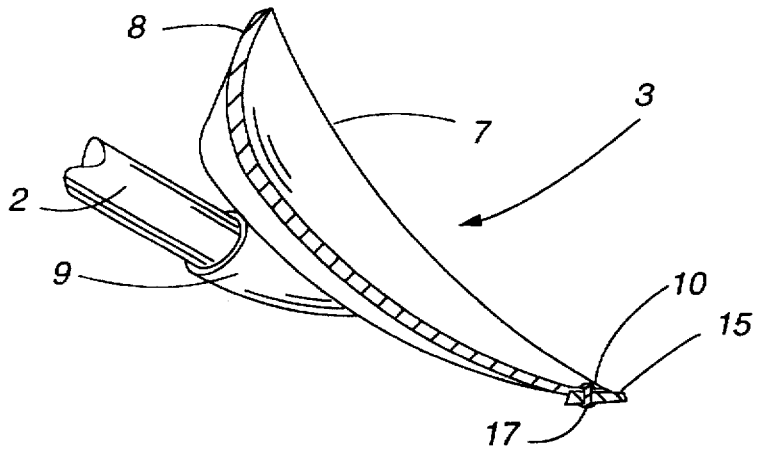
FIG. 4 cross sectional view of scoop and leading edge.

In FIGS. 1 through 4, there is a disclosed a snow shovel of this invention which has a handle 1, a shaft 2 and a scoop, 3 formed from conventional materials.

The preferred-embodiment of the handle 1 is being substantially composed and molded of plastic, such as polyethylene with an opening formed at one end for insertion of a free end of the shaft. 2 The shaft 2 is preferably formed from a single piece of plastic or wood. The scoop 3 is preferably composed of composed of plastic such as polyethylene.

The scoop 3 is a generally rectangular element constructed of plastic having an top surface 4 and a bottom surface, 5 generally parallel lateral sides 6, 7 a back side 8 a shaft coupling joint 9 and a front edge 10 that forms an angle of approximately 160 degrees or two angles of approximately 80 degrees to the center line 11 of the scoop. 3

At least one and preferably two leading edge sections 12, 13 are secured to and project outwardly from the front edge 10 of the scoop 3 so as to be slightly in front of the front edge 10 of the scoop. 3 The preferred embodiment of the leading edge sections 12, 13 are composed of a substantially flat piece of stainless steel with a center notch 14 between two equal length, straight, leading edge sections 12, 13. The notch 14 facilitates the leading edges 12, being composed of one piece. The leading edge sections 12, 13 are manipulated to an angle of approximately 160 degrees so as to match the angulation of the front edge 10 of the scoop, 3 with each section forming angle of 80 degrees with respect to the centerline 11 of the scoop.3 The lateral ends 15, 16 of the leading edge sections 12, 13 intersect with the lateral sides 6,7 to form an angle of approximately 80 degrees with respect to each lateral side.6, 7 The preferred angulation of the leading edge sections 12, 13 is in a range of between 175 degrees and 150 degrees and is preferably 160 degrees. The leading edge sections 12, 13 are preferably riveted to the scoop 3 using retentive holes 17, but may be bolted, welded or any other method which provides sufficient retention of the to the scoop. 3

The snow shovel of this invention is used in a conventional manner. The user applies force to the handle moving shovel in a direction parallel to the handle and in a direction 10 degrees oblique to the leading edge sections. Each leading edge section applies a shearing force to the snow reducing the amount of energy required for movement through heavy or packed snow. The snow is moved and removed from the scoop in a conventional manner. While the illustrated shape of the shovel and leading edge is preferred, it is understood that it can be of other configurations.

It is contemplated that the inventive concepts herein described may be variously other wise embodied and it is intended that the appended claims be construed to include alternative embodiments of the invention except insofar as limited by the prior art.

What is claimed is:

1. A shovel device comprising:

a generally rectangular scoop element constructed of plastic having a top surface, a bottom surface, generally parallel lateral sides, a back side, a shaft coupling joint, and a front edge;

a shaft constructed from a single piece of plastic inserted into a said shaft coupling joint of said scoop element;

a handle element molded from plastic with and opening formed at one end for insertion of said shaft; and a leading edge element comprising two connected sections which form an angle of less than 180 degrees therebetween such that when the leading edge element is attached to the front edge of said scoop element, a front portion of the lateral sides of said scoop element extent forwardly beyond the point where said two sections are connected.

* * * * *